US005533366A

United States Patent [19]

Mista et al.

[11] Patent Number: 5,533,366

[45] Date of Patent: Jul. 9, 1996

[54] WARP KNITTING MACHINE HAVING AT LEAST ONE GUIDE BAR AND REPLACEMENT UNIT FOR SUCH A WARP KNITTING MACHINE

[75] Inventors: Kresimir Mista, Heusenstamm; Hans J. Hohne, Hainburg, both of Germany

[73] Assignee: Karl Mayer Textilmaschinenfabrik GmbH, Obertshausen, Germany

[21] Appl. No.: 449,395

[22] Filed: May 24, 1995

[30] Foreign Application Priority Data

May 28, 1994 [DE] Germany ..... 44 18 714.9

[51] Int. Cl.[6] ..... D04B 27/24

[52] U.S. Cl. ..... 66/205; 66/207

[58] Field of Search ..... 66/83, 203, 204, 66/205, 207, 214, 85 R, 218, 219, 220, 221, 125 R

[56] References Cited

U.S. PATENT DOCUMENTS

| | | | |
|---|---|---|---|
| 4,092,838 | 6/1978 | Coaigi | 66/214 |
| 4,549,414 | 10/1985 | Zorini et al. | 66/214 |
| 4,841,750 | 6/1989 | Zorini | 66/204 |
| 5,027,619 | 7/1991 | Saito | 66/218 |

FOREIGN PATENT DOCUMENTS

| | | | |
|---|---|---|---|
| 210790 | 2/1987 | European Pat. Off. | 66/218 |
| 0544527 | 11/1992 | European Pat. Off. . | |
| 0583631 | 7/1993 | European Pat. Off. . | |
| 4316396 | 9/1994 | Germany . | |
| 2283501 | 5/1995 | United Kingdom . | |

*Primary Examiner*—C. D. Crowder
*Assistant Examiner*—Larry D. Worrell, Jr.
*Attorney, Agent, or Firm*—Omri M. Behr

[57] ABSTRACT

A warp knitting machine having at least one guide bar (1) comprises a plurality of retaining segments (11) releasably attached to the guide bar (1). The retaining segments receive in each case a subassembly (17) of piezoelectric bending transducers (9) for displacing the guides by a knitting needle space. The control lines leading to the bending transducers (9) are provided with connector contacts (37) for the purpose of being releasably connected to the control device (42). In this way, it is possible to replace rapidly guide, bending transducers or control lines.

23 Claims, 3 Drawing Sheets

Fig.3
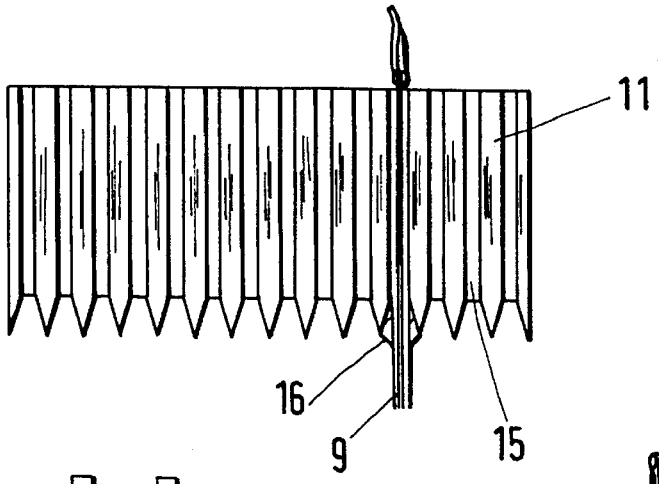
Fig.8
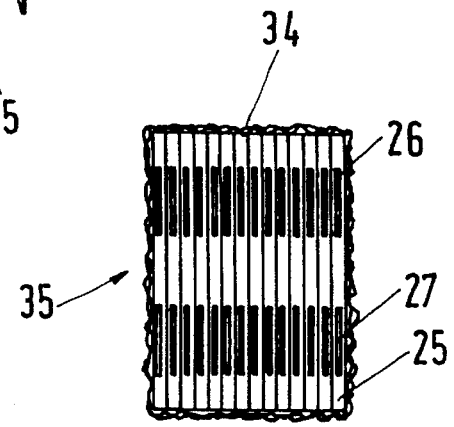
Fig.4
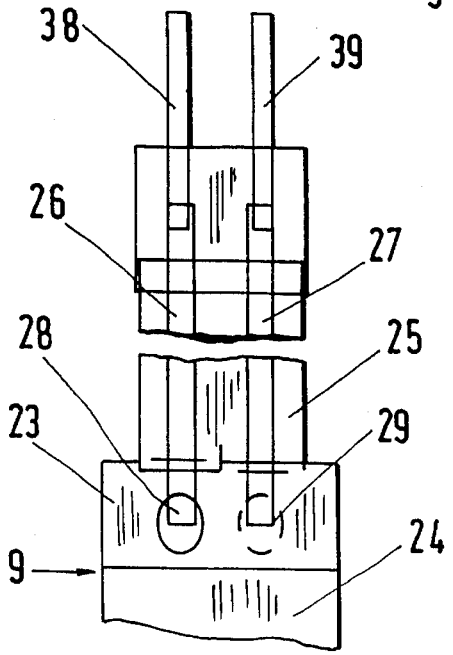
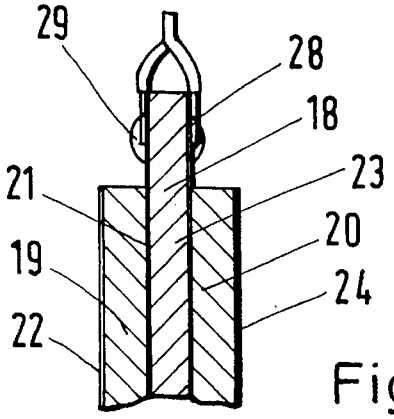
Fig.5
Fig.6
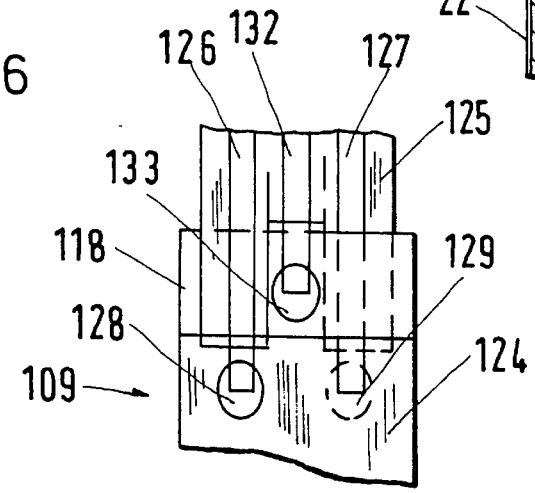
Fig.7
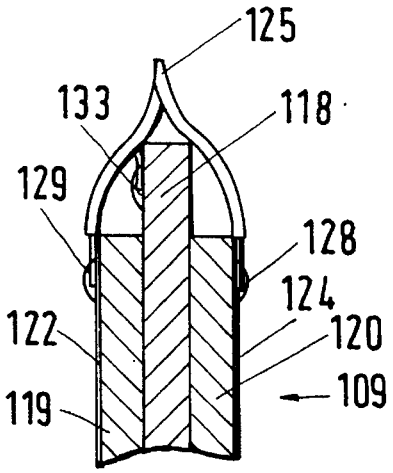

WARP KNITTING MACHINE HAVING AT LEAST ONE GUIDE BAR AND REPLACEMENT UNIT FOR SUCH A WARP KNITTING MACHINE

1. FIELD OF THE INVENTION

The present invention relates to a warp knitting machine having at least one guide bar, wherein adjacent, strip-shaped piezoelectric bending transducers each bear at a distal end a guide and are received at each proximal end in a retaining device and wherein the bending transducers are also connected to control lines that convey signals emitted by a control device for the purpose of displacing the guide by one warp needle space; as well as to a replacement unit for such a warp knitting machine.

2. BACKGROUND OF RELATED ART

In the case of a known warp knitting machine of this type (DE-PS 42 26 899) the guide bar comprises a continuous retaining device and the ends of plate-shaped carriers are attached, for example by means of adhesive, into the slots of the retaining device. The carriers are in each case part of a piezoelectric bending transducer, the outer electrode of which is provided with a control line, whereas the electric conductive carrier is grounded. The control lines are routed along the guide bar and are connected at the other end to a control device which is illustrated only diagrammatically.

However, problems arise when it is necessary to change a guide, for example due to wear, or a bending transducer, for example due to failure. In this case, the mechanical connection between the retaining device and the bending transducer must first be interrupted at the site of the assembled machine or reconnected later. Moreover, the soldered joints between the control line and the electrode, which first need to be separated and later reconnected, are extremely difficult to access. There is also the danger that adjacent bending transducers can also be affected detrimentally during the repair process.

Therefore, an object of the present invention is to produce a warp knitting machine of the type mentioned in the introduction, wherein the process of replacing the bending transducers and/or the guides is substantially simplified.

SUMMARY OF THE INVENTION

In accordance with the illustrative embodiments demonstrating features and advantages of the present invention, there is provided a warp knitting machine having at least one guide bar. The machine also has a retaining device with a plurality of retaining segments releasably attached to the guide bar. Also included are a plurality of subassemblies each having a plurality of strip-shaped piezoelectric bending transducers. Each of the bending transducers have: (a) a group of control lines for controlling that one of the bending transducers, (b) a proximal end attached at the retaining device, and (c) a distal end having a guide. The knitting machine also has a control device for transmitting control signals signifying displacement of the guides by one needle space. Also included are a plurality of connector contacts separately connected to different associated ones of the control lines of the bending transducers for releasably connecting to the control device and conveying the control signals to the control lines.

Accordingly, an improved knitting machine in accordance with the present invention employs a retaining device having a plurality of retaining segments, which are releasably attached to the guide bar. Preferably, these retaining segments in each case receive a subassembly of bending transducers. The control lines leading to the bending transducers are connected to the control device by means of connector contacts for the purpose of providing a releasable connection.

It is possible in the case of this preferred construction by virtue of releasing a retaining segment and removing the connector contacts from their countercontacts, to remove a subassembly of bending transducers and associated guides from the warp knitting machine in a convenient manner and to replace said subassembly in a likewise convenient manner by an analogue subassembly. The dismantled subassembly can be repaired completely independently from the warp knitting machine. The down-times are therefore short. The subassembly can be accessed from all sides and is therefore substantially easier to repair than previously. If the bending transducer is disconnected from the retaining segment, either by releasing the connecting adhesive or by removing a mechanical lock, then a unit can be removed, wherein the bending transducer, guide, control lines and connector contacts form one unit. This unit can be exchanged for a replacement unit. Moreover, the connection sites between the control line and electrodes of the bending transducer can be easily reached, so that it is possible to provide a new connection between the control lines and the bending transducer.

The preferred connector contacts of all control lines of the subassembly are combined expediently to form a multi-contact connector. The use of a multi-contact connector enables the entire subassembly to be uncoupled rapidly from the control device.

It is preferred that each bending transducer is allocated a two- or three-wire ribbon cable and the wires of said cable form its control lines. The ribbon cables, wherein two or three wires lie adjacent to each other, can be disposed in the extension of the strip-shaped bending transducer and can therefore be accommodated in a space-saving manner and connected to the bending transducers.

Preferably, at the end of each ribbon cable, each wire is connected to a connector contact and by injection molding with a synthetic material a head part is formed and that the head parts can be releasably received in a casing of the multi-contact connector. In this manner, it is also possible to dismantle the multi-contact connector into individual connector units which facilitates the repair and the possibilities of replacing the unit.

Also in a preferred embodiment, a casing comprises parallel grooves into which strips provided on the head part can engage and can be locked by virtue of a securing wire. This produces an extremely convenient yet operationally reliable construction. It is particularly expedient that all control lines of one subassembly are combined by means of a sleeve to form one cable bundle. The sleeve ensures that the individual control lines and ribbon cables are held together. In this way, individual control lines are prevented from colliding with the threads forming the guide. In addition, vibrations are reduced.

The sleeve is advantageously a fabric or woven sleeve, which renders it substantially more convenient to pull on than for example a silicon sleeve. Moreover, lighter material can be used.

In the case of one preferred embodiment, the control device is supported on a stationary machine part. However, the knitting needle bar can move only in the stroke direction and the guide bar can be displaced both axially and also pivoted into overlap and underlap positions. The preferred control lines have at least a length which permits clearance for this movement. Because the guide bar does not need to be connected to the control device by way of a harness-tie or the like, but rather by way of electric control lines, the guide bar provided with the adjustable needles is able to swing through, and it is possible to use a knitting needle bar which does not perform a swing movement. Care must be taken that the control lines leading from the guide bar to the control device are of sufficient length to ensure that no unacceptable tensile forces are exerted on the control lines.

In particular, the control lines can be of such length that the guide bar can be taken off its bearing without releasing the connector contacts. It is therefore possible to take off a guide bar without dismantling the remaining parts, for example, in order to be able to access more easily the machine parts disposed to the rear thereof.

It is expedient that cable bundles are fixed to the guide bar and/or to the multi-contact connector by virtue of a locking device, which relieves the strain on the connection sites at the ends of the control lines.

It is also advantageous if the control lines and cable bundle extend from the guide bar to the control device whilst forming a 360° loop, by means of which the bending load of the control lines and cable bundle at the ends is maintained small, which increases the serviceable life. The 360° loop compensates both the swing movement of the guide bar, (which causes a considerable change in the spacing of the clamping points of the cable bundle) and also the axial displacement.

In the case of a preferred embodiment, the retaining segments have parallel grooves into which the bending transducers are disposed and attached as a subassembly. The bending transducers can be placed easily in these grooves either in a mechanical manner or in any other manner.

In particular, the bending transducers can be attached in the grooves by virtue of applying an adhesive or synthetic material. This filler simultaneously serves to dampen vibration. If the grooves widen at the open end and also receive there the filler, then the bending load of the guides at this site is reduced.

Preferably, the retaining segments have grooves, which are open towards the front. Also the retaining segments can engage with their rearward part in a longitudinal groove of the guide bar and be are held at the installation site by means of a strip which is releasably attached to the guide bar. In this way, the retaining segments are reliably installed in position yet they can be easily released from the guide bar.

It is recommended that the bending transducers comprise in each case a strip-shaped carrier which supports on both sides an active layer, which consists of a piezoelectric material and comprises an inner and an outer electrode. The symmetrical design produces substantially symmetrical operating conditions. If one active layer is excited, then the guide is placed at a left stop on the guide bar and if the other active layer is excited, then the guide is placed at a right stop.

In the case of a preferred embodiment it is therefore ensured that the carrier consists of an electric insulating material, the two outer electrodes are grounded and the two inner electrodes are each connected to a control line. This produces a highly reliable contact because the electric voltage only occurs in the inside of the bending transducer.

A further preferred possibility resides in the fact that the carrier consists of an electric conductive material and simultaneously forms the inner electrode and that the carrier and the two outer electrodes are each connected to a control line. No additional layers are required for the inner electrodes.

It is then expedient that the guide is held by two wall portions which lie at the free end of strip-shaped carrier on both sides thereof. The guide attachment is therefore also of a symmetric construction. The wall portions extend in the extension of the active layers of the bending transducer. The bending transducer can therefore be of the same thickness throughout.

A great simplification exists if the connection between the active layer and the carrier and/or between the electrode and control line and/or between the carrier and wall portions is an adhesive connection. A carrier provided with adhesive layers can for example be covered in a convenient manner with the active layer and wall portions. An adhesive connection increases the strength of the electric connection between the electrode and the control line.

It is of particular advantage if a guide holder, in which is releasably attached a guide, is attached at the free end of the strip-shaped bending transducer. In this way, and individual guide can be easily replaced if it is worn or damaged in any other way.

The present invention relates also to a replacement unit for a warp knitting machine, which is characterized by a strip-shaped piezoelectric bending transducer, a guide connected at one end, control lines connected at the other end to the electrodes of the bending transducer and connector contacts at the ends of the control lines remote therefrom.

Moreover, a replacement unit is of advantage in which a subassembly of bending transducer is attached in a retaining segment and all control lines are connected to a multi-contact connector.

BRIEF DESCRIPTION OF THE DRAWINGS

The invention is further explained hereinunder with reference to preferred embodiment illustrated by way of example in the drawings, in which:

FIG. 3 shows a plan view of a retaining segment employed in the apparatus of FIG. 1, FIG. 4 shows a plan view of the connection region of the bending transducer of FIG. 1, FIG. 5 shows a longitudinal sectional view of a portion of the bending transducer of FIG. 4, FIG. 6 shows a plan view of the connection region of a modified bending transducer that is an alternate to that of FIG. 4, FIG. 7 shows a sectional view through the bending transducer of FIG. 6, FIG. 8 shows a sectional view through the cable bundle of FIG. 2.

DETAILED DESCRIPTION OF THE PREFERRED EMBODIMENTS

Figure 1:
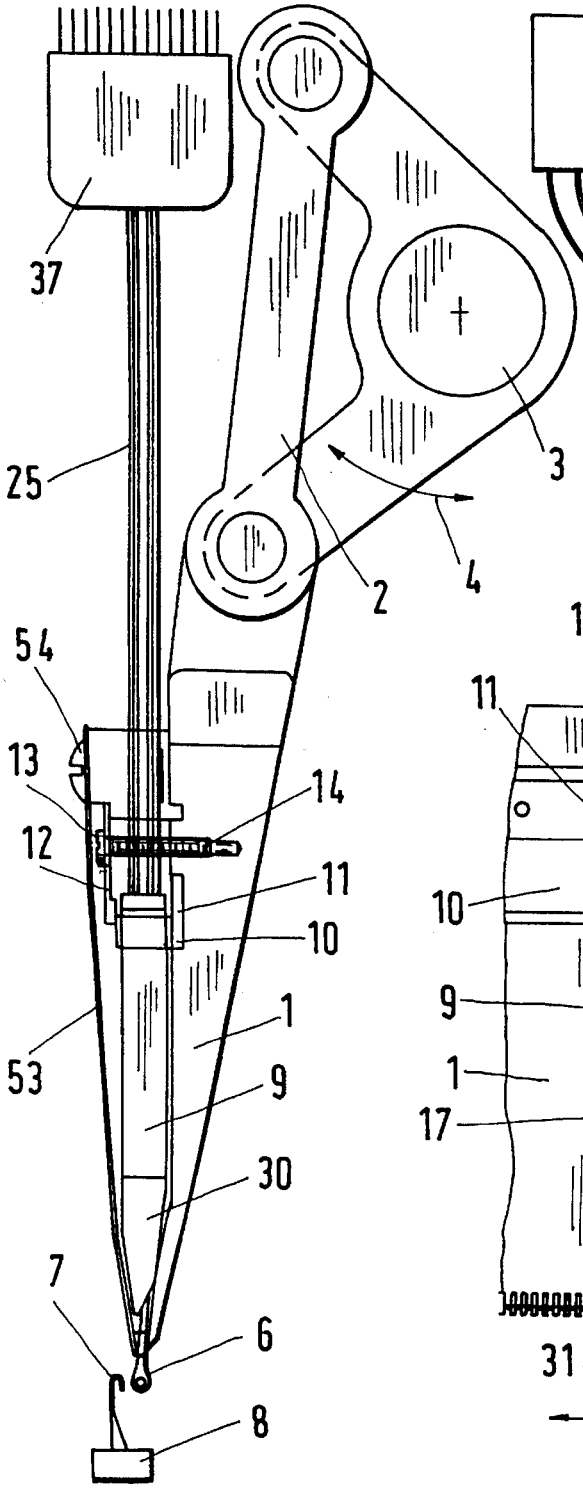
FIG. 1 shows an end view, partially in cross-section view, of a guide bar arranged with components in accordance with principles of the present invention.
Figure 2:
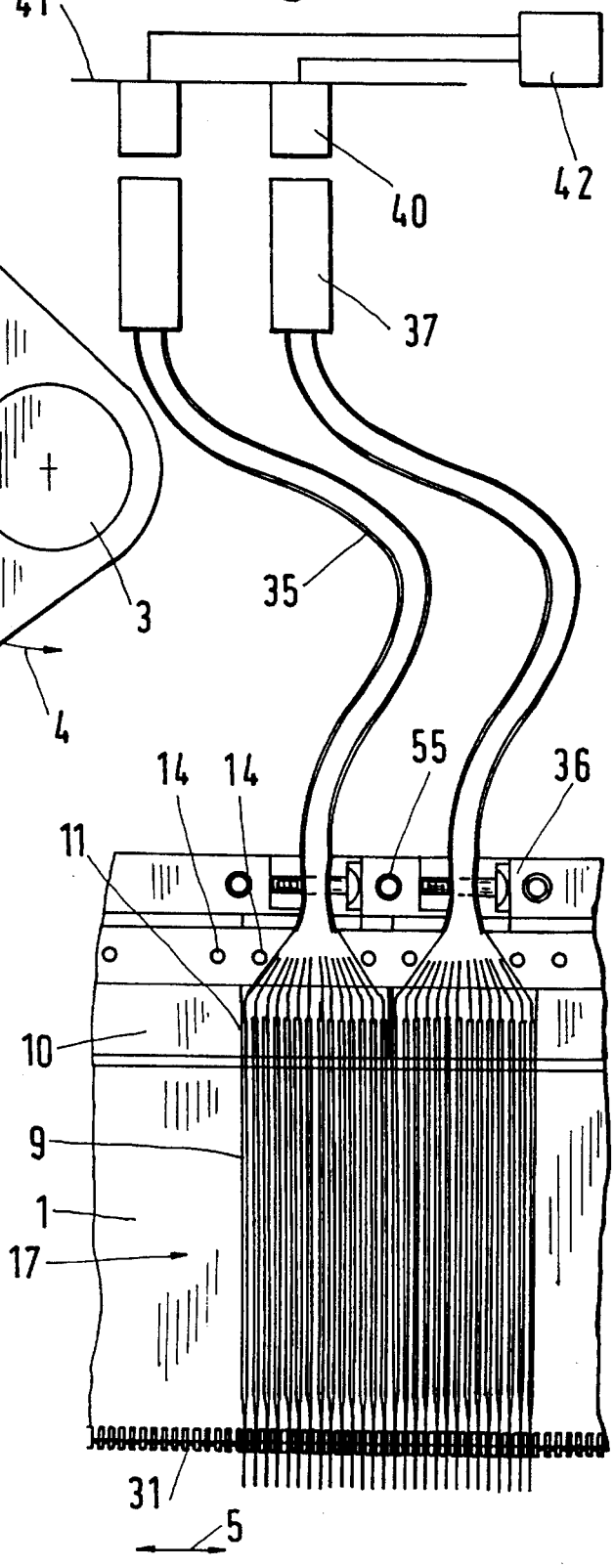
FIG. 2 shows a frontal view of this guide bar.

Referring to FIGS. 1, 2 and 3, a guide bar 1 is attached at the pivot levers 2 in such a manner that it can pivot about an axle 3 (arrow 4) and that it can be displaced in its longitudinal direction (arrow 5). The guides 6 attached to the guide bar 1 can therefore swing through the channels which are formed by the knitting needles 7 of the knitting needle bar 8, which can move only in the stroke direction and from an overlap and an underlap. The guides 6 are at a spaced disposition of two needle spaces (pitches) compared to the knitting needles 7 and can be displaced with the aid of piezoelectric bending transducers 9 in each case by one knitting needle space.

Further guide bars of the warp knitting machine are not illustrated. In order to be able to produce an integral material, at least one further guide bar is provided either as a guide bar, (the guides of which are disposed at a spaced disposition equal to one knitting needle space and are not individually displaceable) and/or a guide bar corresponding to the illustrated guide bar, (the bending transducers of which are displaced by one knitting needle space with respect to the bending transducer 9).

The guide bar 1 comprises a longitudinal channel 10, into which the retaining segments 11 fit with their rearward part. These retaining segments are held in situ by virtue of a strip 12 that is secured to the guide bar 1 with the aid of screws 13, which engage in threaded bores 14.

Each of the numerous retaining segments 11 are disposed adjacent to each other in the channel 10. segments 11 each have a number of grooves 15 which are open towards the front and which widen at the front end. Each of the grooves 15 receive a piezoelectric bending transducer 9 which is attached in the groove 15 by virtue of an adhesive filler 16 which serves simultaneously as a vibration damping means. In the wider region the adhesive prevents the bending transducer from being excessively loaded. It is possible to remove the adhesive by dissolving it, for example using acetone, if the bending transducer 9 is to be removed for repair or replacement. In the present embodiment illustrated by way of example, fourteen bending transducers 9 form a subassembly 17, which are supported by a common retaining segment 11.

A guide holder 30, which preferably releasably holds guide 6, is attached at the free (distal) end of the carrier 18. Stops 31 for the guide 6 are provided at the lower end of guide bar 1, which stops determine the left and right end position of the guides.

In the case of the embodiment as shown in FIGS. 4 and 5, the bending transducer 9 comprises a strip-shaped carrier 18 made from an electrically insulating material; for example, from a glass fiber reinforced synthetic material, which bears on both sides an active layer 19 and 20 made from a piezoelectric material. The active layer 19 comprises an inner electrode 21 and an outer electrode 22, and the active layer 20 comprises an inner electrode 23 and an outer electrode 24. The two wires of a ribbon cable form the control lines 26 and 27, which are connected by means of adhesive, solder or welding at the sites 28 and 29 to the inner electrodes 23 and 21, which protrude beyond the active layers 19 and 20. The two outer electrodes 22 and 24 are grounded by the fact that the retaining segments 11 (FIG. 3) consist of an electrically conductive material and contact the outer electrodes in the groves 15, so that electrodes 22 and 24 are held at the ground potential of the machine framework.

If a voltage signal, in particular a short pulse, is directed along the control line 26, the active layer 19 (FIG. 5) is subjected to an electrical field. The bending transducer 9 bends towards the left (FIG. 2) until the guide 6 comes into position against the right side of a stop 31. This position is even maintained without further voltage supply, because the active layer having the inner and outer electrode is effective as voltage-holding capacitor. If subsequently a voltage signal is directed along the control line 27, then the bending transducer 9 bends towards the right until the guide comes into position at the left side of a stop 31.

In the case of the embodiment as shown in FIGS. 6 and 7, a piezoelectric bending transducer 109 is illustrated, which comprises a carrier 118 made from an electrically conductive material, for example, from a carbon fiber reinforced synthetic material. The two active layers 119 and 120 bear only an outer electrode 122 and 124, respectively, because the carrier is simultaneously effective as the inner electrode. In this case, the ribbon cable 125 comprises three wires, namely two control lines 126 and 127, as well as a ground line 132. The two control lines are connected at the sites 128 and 129 to the outer electrodes 124 and 122, whereas the ground line 132 is connected at site 133 to the carrier 118. In the case of this construction the retaining segment (not shown) consists of an electrically insulating, synthetic material. By supplying a voltage signal to the outer electrode 122 or 124 the bending transducer 109 is deflected towards the left or towards the right.

Referring to FIG. 8, all ribbon cables 25 and thus all control lines 26, 27, which are associated with a retaining segment, are combined to form a batch of lines and are surrounded by a fabric of knitted sleeve 34 so that a multi-core cable bundle 35 is produced. As is evident from FIG. 2, the ribbon cables spread in the region of the guide bar 1 in their longitudinal direction. The longitudinal direction of the multi-contact connector 37 however extends perpendicular to the plane of the drawing. That means, that the ribbon cables are rotated in the plug 37 by 90 degrees. The free length can therefore by bending, easily follow the movement of the guide bar.

Referring again to FIG. 2, cable bundle 35 is fixed to the guide bar 1 by virtue of a clamping device 36. At the other end, the cable bundle 35 is fixed in a multi-contact connector 37. In FIG. 4, this multi-contact connector is shown comprising a pin 38, 39 for each control line 26, 27. These pins are welded to the ends of the control lines and injection molded to form a connector unit. The connector units are held adjacent to each other in the casing of the multi-contact connector 37 (FIG. 2) but they can also be separated again. The multiple plugs 37 are inserted into multiple sockets 40, which are provided on a stationary machine part 41 and form part of control device 42. The control device 42 comprises in the conventional manner, a guide memory, which emits in dependence upon the rotational angle of the main shaft (not shown) voltage signals for the purpose of actuating the bending transducer 9.

If it is necessary to perform a replacement in the region of the bending transducer 9 of the guides 6, then it is possible after removing the multi-contact connector 37 from the multiple socket 40, and after releasing two screws 13 (FIG. 1) and opening the clamping device 36 (FIG. 2), to remove the associated retaining element 11 with the bending transducers 9, the guides 6 and the cable bundle 35. This subassembly can be replaced immediately with a corresponding replacement unit, so that the down-time of the machine is extremely short. Subsequently, a repair can be carried out outside the machine. The further advantage is produced in that by virtue of removing the adhesive 16 (FIG. 3), the bending transducer 9 can be removed so that the connection sites 28, 29 (FIGS. 4 and 5), which are accommodated in the groove 15 and well protected during operation, are easily accessible for repair.

Figure 9:
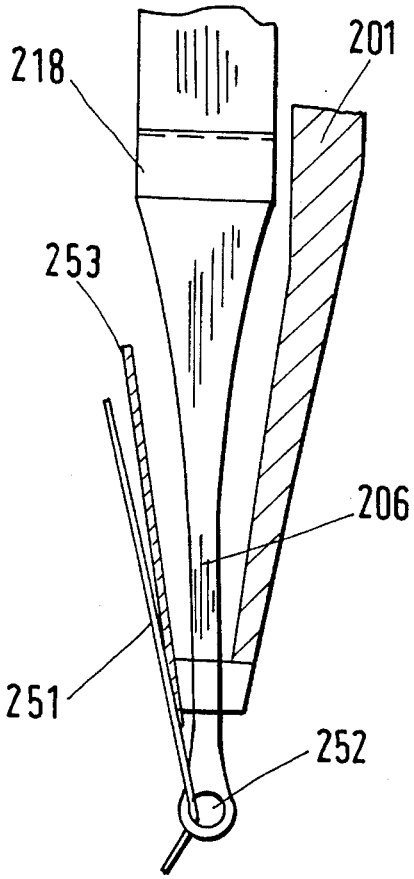
FIG. 9 shows in plan detail a guide region that may be employed in the apparatus of FIG. 1.
Figure 10:
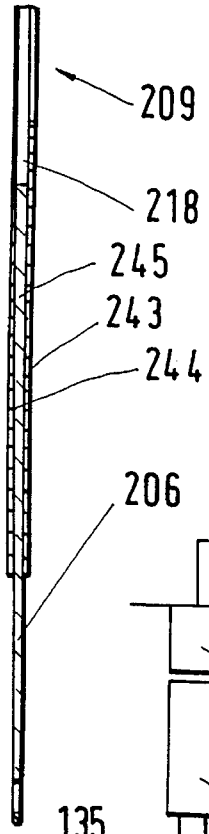
FIG. 10 shows a longitudinal, sectional edge view of the guide region of FIG. 9.

In the case of the embodiment as shown in FIGS. 9 and 10, the guides 206 disposed on the guide bar 201 are formed with their needle shaft as an integral part. The structure comprises three plates 243, 244 and 245, which are welded or soldered together. The outer plates 243 and 245 extend beyond the free end of a carrier 218 of a bending transducer 209. The central plate 244 forms the guide 206.

FIG. 9 and 10 moreover illustrate that the thread 251 penetrates a hole 252 in the guide and is guided by a plate 253 attached to the guide bar 201. Such a plate 53 is also illustrated in FIG. 1, held at the upper end by means of a screw 54, which engages in a threaded bore 55 (FIG. 2) of the guide bar 1.

Figure 11:
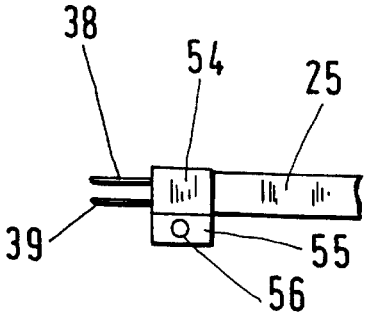
FIG. 11 shows a plan view of the head part of a ribbon cable that may be used with the apparatus of FIG. 1.

Referring to FIG. 11, ribbon cable 25 is injection molded with synthetic material at the free end, where it bears the pins 38 and 39, so that a head 54 is formed. This head comprises a strip 55 in which is located a hole 56.

Figure 12:
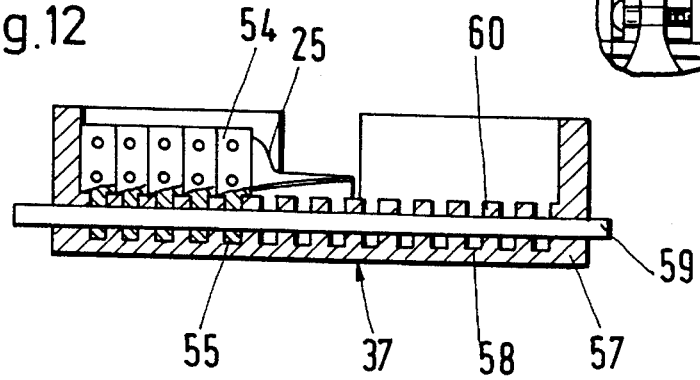
FIG. 12 shows a cross-sectional view through a multi-contact connector that may be used with the apparatus of FIG. 1.

Referring to FIG. 12, multi-contact connector 37 comprises a casing 57 having a plurality of grooves 58. The strips 55 of the heads 54 are pushed into these grooves and secured by means of a wire 59 which engages through the holes 56 of the heads 54 and the holes 60 in the casing 57. In this manner, individual ribbon cables 25 can be removed and replaced by a replacement item.

Figure 13:
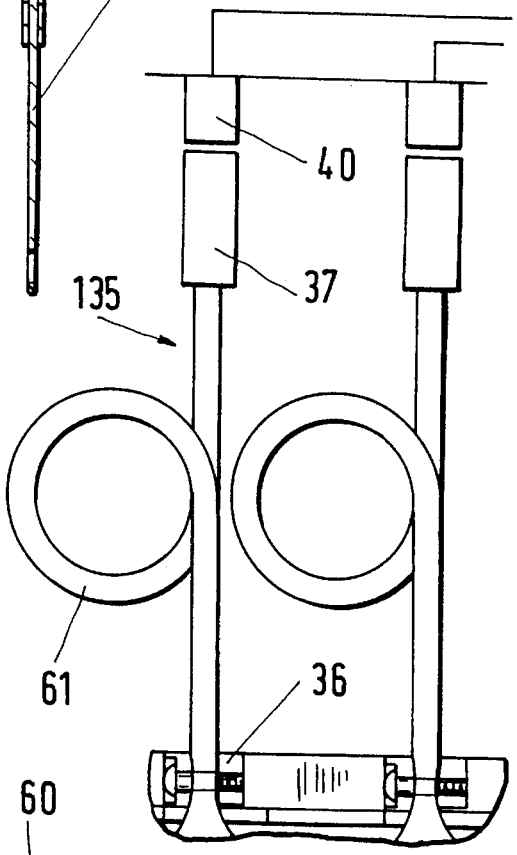
FIG. 13 shows an alternative routing of the cable bundles of FIG. 2.

Referring to FIG. 13, the cables 135 between the clamping device 36 and the multi-contact connector 37 have a 360° loop 61. This loop is easily deformable both in the longitudinal direction of the cable bundle 135 and also transversely thereto, without excessive bending forces occurring at the two ends.

Numerous deviations from the illustrated embodiments are possible without abandoning the fundamental ideas of the invention, For example, the bending transducers can be attached in a different manner in the retaining segment 11; for example, by means of fixing clamps by virtue of a cover placed in position from the outside or by virtue of another mechanical locking device. The number of the bending transducers combined to form a subassembly depends upon the practical requirements and is not limited to 14. The guide bar 1 can also, as was conventional in the case of Jacquard guide bars, cooperate with a swing hitting needle bar and itself only be displaced axially.

We claim:

1. A warp knitting machine comprising:

at least one guide bar;

a retaining device having a plurality of retaining segments releasably attached to the guide bar;

a plurality of subassemblies each having a plurality of strip-shaped piezoelectric bending transducers, each of the bending transducers having: (a) a group of control lines for controlling that one of the bending transducers, (b) a proximal end attached at said retaining device, and (c) a distal end having a guide;

a control device for transmitting control signals signifying displacement of the guides by one needle space; and a plurality of connector contacts separately connected to different associated ones of the control lines of said bending transducers for releasably connecting to the control device and conveying said control signals to said control lines.

2. A warp knitting machine according to claim 1, wherein the connector contacts of the control lines are grouped to form for each of the subassemblies, a multi-contact connector.

3. A warp knitting machine according to claim 2, wherein the control lines comprise:

a plurality of ribbon cables each having at least two wires connected to a corresponding one of said bending transducers.

4. A warp knitting machine according to claim 2, wherein said multi-contact connector comprises:

a plurality of head parts each molded around a portion of the control lanes of a corresponding one of said bending transducers at their junctions with said connector contacts; and a casing for releasably holding the head parts.

5. A warp knitting machine according to claim 4, wherein said head parts each have a projecting member, the casing having a plurality of parallel grooves sized to hold the projecting members provided on the head parts, said machine including means for locking said projecting members in said casing.

6. A warp knitting machine according to claim 3, comprising:

a plurality of sleeves each separately encircling the control lines of each subassembly to form a plurality of cable bundles.

7. A warp knitting machine according to claim 6, wherein each of the sleeves comprise either fabric or knitted material.

8. A warp knitting machine according to claim 4, wherein the control device is mounted on a stationary portion of said machine, said machine comprising:

a knitting needle bar mounted to reciprocate in a stroke direction, the control lines being attached to the guide bar and to the control device and having a length sized to allow said guide bar to shog and to swing between an overlap and an underlap position.

9. A warp knitting machine according to claim 8, wherein the guide bar has a support bearing, the control lines having a length sized to allow the guide bar to be removed from said bearing without releasing the connector contacts.

10. A warp knitting machine according to claim 6, comprising:

a plurality of locking devices for holding the cable bundles to the guide bar.

11. A warp knitting machine according to claim 10, wherein the control lines and cable bundles extend from the guide bar to the control device in the form of a 360° loop.

12. A warp knitting machine according to claim 3, wherein the retaining segments have a plurality of parallel grooves in which the bending transducers of the subassemblies are separately disposed and attached.

13. A warp knitting machine according to claim 12, wherein the bending transducers are attached in the grooves by applying either an adhesive or synthetic material.

14. A warp knitting machine according to claim 12, wherein the grooves each have a flared, distal, open end.

15. A warp knitting machine according to claim 4, wherein the guide bar has a longitudinal channel, the retaining segments each having one side with grooves and an opposite side sized to mount into said longitudinal channel, said machine including a strip releasably attached to the guide bar for holding said retaining segments in place.

16. A warp knitting machine according to claim 4, wherein the bending transducers comprise:

a strip-shaped carrier; and a pair of active layers mounted on opposite sides of said strip-shaped carrier, each of said layers having a piezoelectric material overlaid on opposing sides with an inner and outer electrode.

17. A warp knitting machine according to claim 16, wherein the carrier comprises an electric insulating material, the outer electrode of each of the layers being grounded, the inner electrode of each of the layers being separately connected to a corresponding one of the control lines.

18. A warp knitting machine according to claim 4, wherein the bending transducers (9) comprise:

an electrically conductive, strip-shaped carrier; and a pair of active layers mounted on opposite sides of said strip-shaped carrier, each of said layers having a piezoelectric material externally overlaid on with an outer electrode, the carrier acting as an inner electrode for said layers, said outer electrode of each of the layers being separately connected to a corresponding one of said control lines.

19. A warp knitting machine according to claim 1, comprising a plurality of small walls interdigitated with the distal ends of the bending transducers for limiting motion of the guides.

20. A warp knitting machine according to claim 16, wherein the active layer and the carrier are adhesively connected, the outer and inner electrodes each being adhesively connected to a corresponding one of the control lines.

21. A warp knitting machine according to claim 1, wherein said subassemblies each have a guide holder attached at the distal end of the bending transducer, said guide being releasably attached in said guide holder.

22. Replacement unit for a warp knitting machine according to claim 1, wherein said strip-shaped, piezoelectric bending transducers include a plurality of electrodes connected about the proximal end of said transducer to corresponding ones of the control lines, each of the control lines having a connector contact positioned remotely from the transducers.

23. Replacement unit according to claim 22, wherein the connector contacts of the control lines are grouped to form for each of the subassemblies, a multi-contact connector whose corresponding subassembly of bending transducers is attached to the guide bar by one of the retaining segments.

* * * * *